US006892667B2

(12) United States Patent
Suganuma et al.

(10) Patent No.: US 6,892,667 B2
(45) Date of Patent: May 17, 2005

(54) CONTINUOUS PLATING METHOD OF FILAMENT BUNDLE AND APPARATUS THEREFOR

(75) Inventors: Nobuyuki Suganuma, Nagoya (JP); Hiroshi Kobayashi, Nagoya (JP); Suehiro Kamizono, Nagoya (JP); Tom Wong, Hong Kong (CN)

(73) Assignee: Nagoya Mekki Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/303,956

(22) Filed: Nov. 26, 2002

(65) Prior Publication Data

US 2003/0224111 A1 Dec. 4, 2003

(30) Foreign Application Priority Data

May 29, 2002 (JP) ..... 2002-155381

(51) Int. Cl.[7] ..... B05C 11/00

(52) U.S. Cl. ..... 118/33; 118/420; 118/423

(58) Field of Search ..... 118/33, 420, 427, 118/425, 423, 424; 204/206; 57/296, 295; 68/22 R; 427/175, 443.1; 28/240; 26/99

(56) References Cited

U.S. PATENT DOCUMENTS 2,637,659 A * 5/1953 Miller

FOREIGN PATENT DOCUMENTS

| | | |
|---|---|---|
| JP | 1-156574 | 6/1989 |
| JP | 3-51831 | 8/1991 |
| JP | 2001-40578 | 2/2001 |

* cited by examiner

*Primary Examiner*—Brenda A. Lamb
(74) *Attorney, Agent, or Firm*—McDermott Will & Emery LLP

(57) ABSTRACT

A filament bundle is rewound from a reel, and passes through various sorts of liquid in processing vessels to be used for plating. The filament bundle passes through a fixed guide roller and a movable guide roller while it travels within the liquid in the processing vessel. The movable guide roller is moved periodically, the filament bundle is stretched and slackened by turns, whenever the filament bundle is slackened or untied, the bundle is loosened. The filament bundle with each filament subjected to the plating is taken up to a take-up reel.

4 Claims, 5 Drawing Sheets

CONTINUOUS PLATING METHOD OF FILAMENT BUNDLE AND APPARATUS THEREFOR

BACKGROUND OF THE INVENTION

1. Field of the Invention

The present invention relates to a method of and an apparatus for applying plating to bundle of filaments or fibers continuously.

2. Prior Art

First Prior Art (JP, 03-51831, B)

This Prior Art is a method of applying electroplating to a bundle of carbon filaments continuously. A carbon filament bundle is unwound from a reel and then passes through an electrolytic degreasing vessel, a first electroplating vessel and a second electroplating vessel in sequence, and is subjected to electroplating and taken up to a roller. The electroplated carbon filaments are used as a reinforcing material of composite material or for shielding of electromagnetic wave.

In order to apply electroplating to each carbon filament uniformly, the carbon filament bundle is untied during traveling within liquid of each vessel so that the carbon filaments are not contacted with each other. In the first electroplating vessel and the second electroplating vessel respectively, the electroplating liquid jetting from a nozzle is collided in the perpendicular direction with the carbon filament bundle traveling within the electroplating liquid. Thereby the carbon filament bundle is untied so that the electroplating liquid is easily exchanged between the inside and the outside of the carbon filament bundle. Also in the electrolytic degreasing vessel, the electrolytic degreasing liquid jetting from a nozzle is collided in the perpendicular direction with the carbon filament bundle traveling within the electrolytic degreasing liquid. The carbon filament bundle is untied thereby the electrolytic degreasing liquid is easily exchanged between the inside and the outside of the carbon filament bundle.

Second Prior Art (JP, 01-156574, A)

This is a method of applying electroless plating with silver to porous hollow yarns, not to a bundle of filaments. The porous hollow yarns of polyethylene, polypropylene or fluorine-contained resin are wound in loop state and are immersed in a silver salt solution and a reduction solution in sequence and subjected to electroless silver platting. The plated porous hollow yarns are used for filtration.

Third Prior Art (JP, 2001-40578, A)

This is a method of manufacturing white electroconductive yarns, not a bundle of plated filaments. In a plating vessel, a tubular shaft having a number of holes is provided. On this tubular shaft, a yarn wound body with yarn of polyester, nylon or acrylic fibers wound thereon is mounted. A plating liquid flows out of the holes of the tubular shaft and passes the yarn wound body from the inside to the outside thereof. An electroless plating of silver or platinum is applied to the yarn of the yarn wound body. The white electroconductive yarn is used for the shielding of the electromagnetic wave.

SUMMARY OF THE INVENTION

The first object of the present invention is to solve the following problems in the first prior art and the third prior art. In the first prior art, in order to untie the carbon filament bundle in the liquid, the liquid jetting from the nozzle is collided with the carbon filament bundle traveling in the liquid. Therefore a pump device is required to supply the liquid at high-pressure state to the nozzle, and the pump device of large scale having large output is necessary. In the third prior art, the plating liquid passes from the inside to the outside of the yarn wound body. Therefore the pump device to supply the plating liquid at high-pressure state is required, and the pump device of large scale having large output is necessary.

The second object of the present invention is to solve the following problems in the second prior art and the third prior art. In the second prior art and the third prior art, the yarn per each definite length is subjected to the electroless plating. This is the batch process and not the continuous process. Therefore the efficiency of the plating is not high.

The third object of the present invention is to solve the following problems in the first prior art. In the first prior art, the filament, which is subjected to the electroplating, is limited to the carbon filament having electric conductivity. Organic highpolymer filament without electric conductivity such as acrylic resin, aramid, nylon, polyester, rayon, can not be subjected to the electroplating. Further since the carbon filament is only degreased and then subjected to the electroplating, the adhesion property of the electroplating is not high.

The present invention is as follows.

1) In a method of the present invention, a filament bundle is unwound from a reel and passes through various sorts of liquid in processing vessels to be used for plating. While the filament bundle travels within the liquid in the processing vessel, it passes through a fixed guide roller and a movable guide roller. The movable guide roller is moved periodically. By the periodic movement of the movable guide roller, the filament bundle becomes stretched and slackened by turns while it travels within the liquid in the processing vessel. Whenever the filament bundle is slackened or untied, the bundle is loosened. The filament bundle with each filament subjected to the plating is taken up to the take-up reel. The filament bundle is plated continuously.

2) In the above-mentioned method in 1), the filament bundle passes through an inlet guide roller, an adjustment roller and an outlet guide roller. When the filament bundle is loosened, the adjustment roller gets away from the inlet guide roller and the outlet guide roller, and the slackness amount of the filament bundle is decreased.

3) In the above-mentioned method in 1) or 2), the filament bundle is a bundle of organic highpolymer filaments. It passes through an etching processing vessel, a surface adjustment processing vessel for adhering a silane coupling agent to adhere a catalyst, a catalyst processing vessel for adhering the catalyst, an accelerator processing vessel and an electroless plating processing vessel.

4) In the above-mentioned method in 3), the organic highpolymer filament bundle passes through an electroplating processing vessel after passing through the electroless plating processing vessel.

5) In the above-mentioned method in 1) or 2), the filament bundle is a bundle of carbon filaments. It passes through a catalyst processing vessel, an accelerator processing vessel, an electroless plating processing vessel and an electroplating processing vessel.

6) An apparatus of the present invention is provided with a unwinding part assembling a reel with filament bundle wound thereon, a take-up part assembling a take-up reel, and various sorts of liquid processing vessels to be used for the plating. The filament bundle is unwound from the reel and passes through each processing vessel. The filament bundle with each filament subjected to plating is taken up to the take-up reel. In the processing vessel, a fixed guide roller and a movable guide roller are provided where the filament bundle passes through. A mechanism for moving the position of the movable guide roller periodically is provided. By the periodic movement of the movable guide roller, the filament bundle becomes stretched and slackened by turns while it travels within the liquid in the processing vessel. The above-mentioned method in 1) is performed.

7) In the above-mentioned apparatus in 6), the fixed guide roller is arranged at one side within the processing vessel, and the movable guide roller is arranged at another side within the processing vessel. The filament bundle passes through the fixed guide roller at one side and the movable guide roller at another side by turns and is bent.

8) In the above-mentioned apparatus in 6) or 7), a mechanism is provided so as to decrease the slackness amount of the filament bundle when the filament bundle is loosened. The slackness decreasing mechanism is provided with an inlet guide roller, an adjustment roller being movable, and an outlet guide roller where the filament bundle passes through, and the adjustment roller is subjected to force in reverse direction to the force to be received from the filament bundle. When the filament bundle is loosened, the adjustment roller gets away from the inlet guide roller and the outlet guide roller, thereby the slackness amount of the filament bundle is decreased.

[Effect of the Invention]

The filament bundle becomes stretched and slackened by turns while it travels within the liquid of the processing vessel. Whenever the filament bundle is slackened or untied, the bundle is loosened. The liquid is easily exchanged between the inside and the outside of the filament bundle. The plating is easily applied uniformly to each filament of the filament bundle. The filament bundle with each filament subjected to electroless plating or electroplating uniformly can be manufactured continuously and efficiently.

In the electroless plating and the electroplating, copper plating, nickel plating, silver plating, palladium plating, gold plating, platinum plating or the like are exemplified.

In order to repeat the stretch and the slack in the filament bundle during traveling, the position of the movable guide roller may be moved periodically. A drive device of large scale having large output is not required.

The electroplating can be applied not only to the carbon filament with electric conductivity but also to the organic highpolymer filament without electric conductivity. In the organic highpolymer filament, acrylic resin, aramid, nylon, polyester, rayon, polyphenylene sulfide, polypropylene, polyethylene, vinylon, polyvinyl chloride, vinylidene, acetate, cuprammonium rayon or the like are exemplified. Carbon filament can be subjected to the electroless plating and further subjected to the electroplating. The adhesion property of the electroplating becomes higher.

When the organic highpolymer filament bundle is subjected to the electroless plating or is subjected to the electroless plating and further subjected to the electroplating, if silane coupling agent is adhered to the filament, adhesion of the catalyst to the filament becomes strong. The adhesion property of the electroless plating or the electroplating becomes higher.

When the filament bundle is loosened, its slackness amount is decreased. Therefore the tangling of the filament bundle with each other due to the increase of the slackness amount of the filament bundle, the drop of the filament bundle from the guide roller, the contact of the filament bundle with the processing vessel, can be prevented.

BRIEF DESCRIPTION OF THE DRAWINGS

FIG. 1 is a partly lateral sectional view of a continuous plating apparatus of a filament bundle in an embodiment of the invention;

DETAILED DESCRIPTION OF THE PREFERRED EMBODIMENT

[Construction of the Plating Apparatus]

In the plating apparatus of the embodiment, an organic highpolymer filament bundle is subjected to electroless plating and further subjected to electroplating.

Figure 1A:
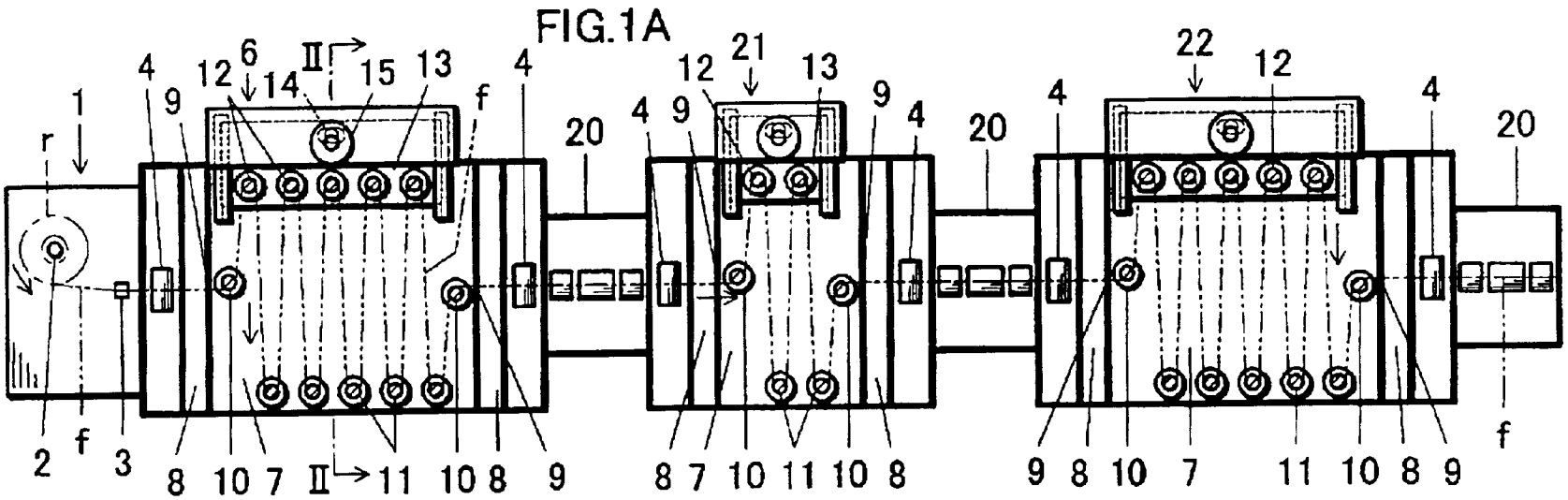
FIG. 1A is a partly lateral sectional view of an unwinding part, an etching part, a neutralization part and a surface adjustment part of the apparatus.

As shown in FIG. 1A, the apparatus comprises a unwinding part 1, an etching part 6, a neutralization part 21 and a surface adjustment part 22 provided in one line in sequence. A water washing part 20 is provided between the etching part 6 and the neutralization part 21. Also between the neutralization part 21 and the surface adjustment part 22, a water washing part 20 is provided. Traveling drive parts 4 are provided respectively at the front side and at the rear side of the etching part 6. Also traveling drive parts 4 are provided respectively at the front side and at the rear side of the neutralization part 21, and also at the front side and at the rear side of the surface adjustment part 22.

Figure 1B:
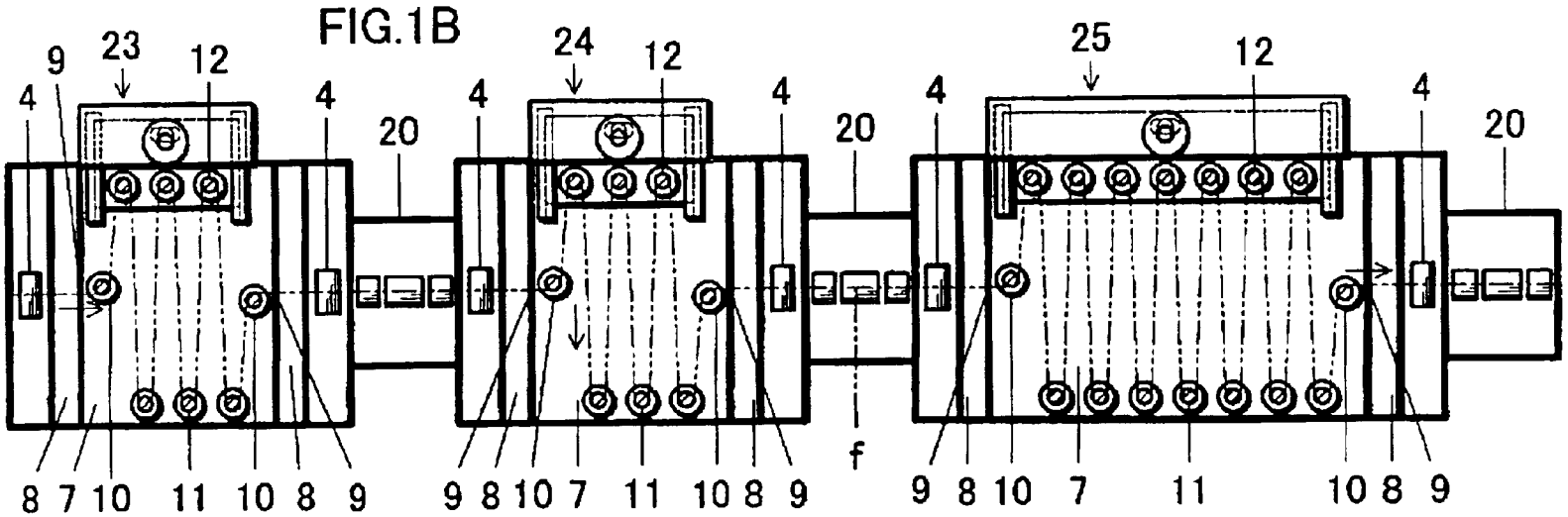
FIG. 1B is a partly lateral sectional plan view of a catalyst part, an accelerator part and an electroless plating part of the apparatus.

Subsequent to the surface adjustment part 22, as shown in FIG. 1B, a catalyst part 23, an accelerator part 24 and an electroless plating part 25 are provided in one line in sequence. A water washing part 20 is provided between the surface adjustment part 22 and the catalyst part 23. Also water washing parts 20 are provided respectively between the catalyst part 23 and the accelerator part 24, and between the accelerator part 24 and the electroless plating part 25. Traveling drive parts 4 are provided respectively at the front side and the rear side of the catalyst part 23. Also traveling drive parts 4 are provided respectively at the front side and at the rear side of the accelerator part 24, and at the front side and the rear side of the electroless plating part 25.

Figure 1C:
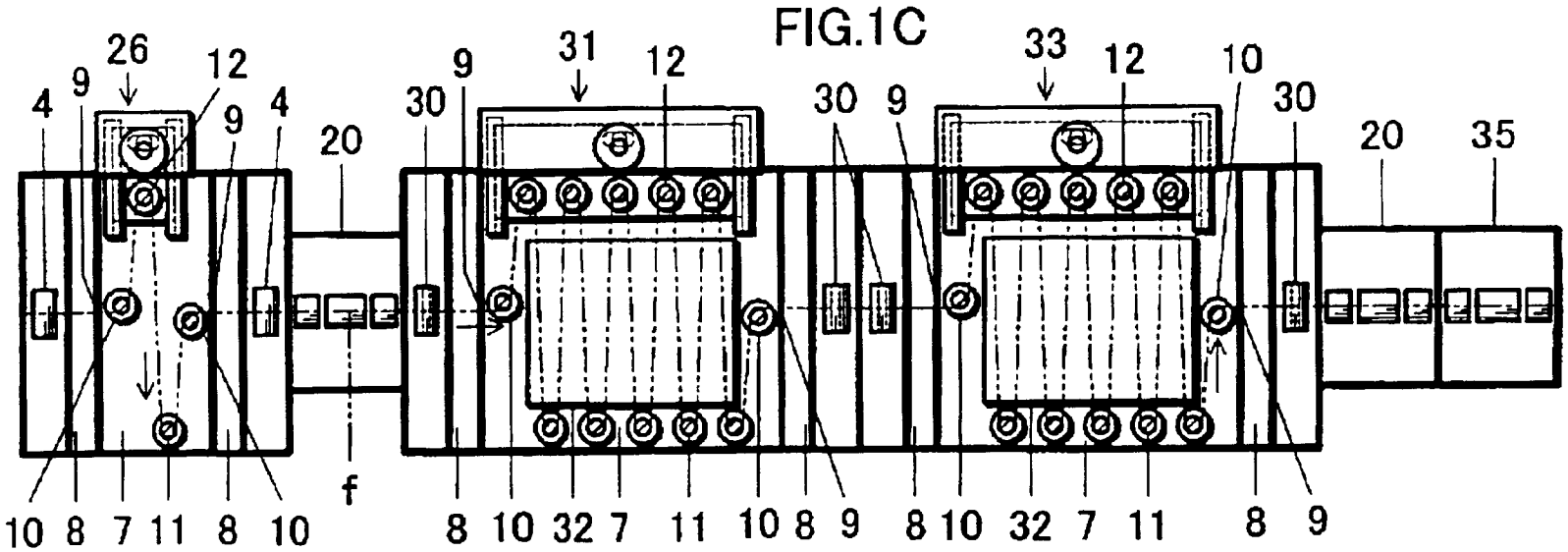
FIG. 1C is a partly lateral sectional plan view of an acid washing part, a first electroplating part and a second electroplating plating of the apparatus.

Subsequent to the electroless plating part 25, as shown in FIG. 1C, an acid washing part 26, a first electroplating part 31 and a second electroplating part 33 are provided in one line in sequence. A water washing part 20 is provided between the electroless plating part 25 and the acid washing part 26. Also a water washing part 20 is provided between the acid washing part 26 and the first electroplating part 31. Traveling drive parts 4 are provided respectively at the front side and at the rear side of the acid washing part 26. Traveling drive parts 30 serving as the cathode feeding parts are provided respectively at the front side and at the rear side of the first electroplating part 31. Also at the front side and at the rear side of the second electroplating part 33, traveling drive parts 30 serving as the cathode feeding parts are provided respectively.

Figure 1D:
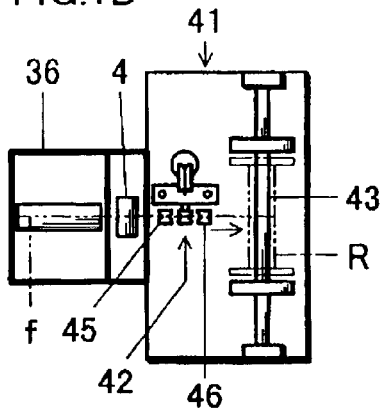
FIG. 1D is a plan view of a warm wind drying part and a take-up part of the apparatus.

Subsequent to the second electroplating part 33, as shown in FIG. 1D, a take-up part 41 is provided. A water washing part 20, a warm water washing part 35 and a warm wind drying part 36 are provided in one line in sequence between the second electroplating part 33 and the take-up part 41. A traveling drive part 4 is provided between the warm wind drying part 36 and the take-up part 41.

In the unwinding part 1, as shown in FIG. 1A, a shaft 2 is provided vertically where a reel r with a filament bundle f wound thereon is mounted rotatably and a guide roller 3 is provided where the filament bundle f unwound from the reel r passes through.

In each traveling drive part 4, two drive rollers to grasp the filament bundle f are provided above and below. When both drive rollers are rotated in opposite directions, the filament bundle f travels.

Figure 2:
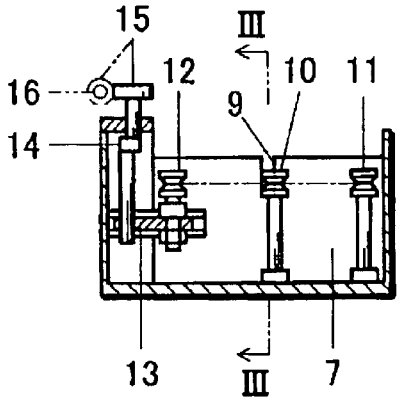
FIG. 2 is a sectional view taken in line II—II in FIG. 1A.
Figure 3:
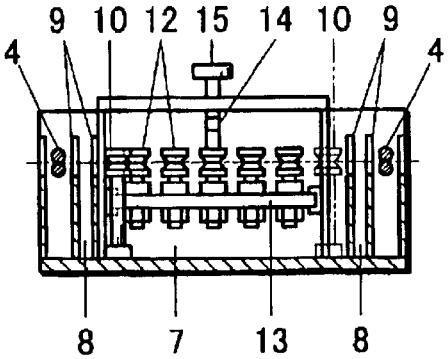
FIG. 3 is a sectional view taken in line III—III in FIG. 2.

In the etching part 6, as shown in FIG. 1A, a processing vessel 7 to hold an etching liquid is provided, and collecting vessels 8 are provided at the front side and the rear side of the processing vessel 7 respectively. On walls at the front side and at the rear side of the processing vessel 7 and the collecting vessel 8, as shown in FIG. 2 and FIG. 3, slender passage ports 9 are provided respectively where the filament bundle f passes through. Liquid flowing out of the passage ports 9 at the front side and at the rear side of the processing vessel 7 flows into the collecting vessels 8 at the front side and the rear side. A circulation mechanism, which is not shown in the drawings, is provided so that the liquid flowing into the collecting vessels 8 at the front side and the rear side is returned to the processing vessel 7.

In the processing vessel 7, as shown in FIG. 1A, guide rollers 10 are provided vertically at the inside position of the passage port 9 being inlet of the filament bundle f and at the inside position of the passage port 9 being outlet of the filament bundle f respectively. Also in the processing vessel 7, guide rollers 11, 12 are provided at the right side and at the left side. The guide rollers 11 at one side and the guide rollers 12 at the other side have equal number and are arranged vertically in equal spacing. The guide rollers 12 have the position movable in the lateral direction, and are the movable guide rollers. The guide rollers 11 have the position fixed, and are the fixed guide rollers.

Figure 4:
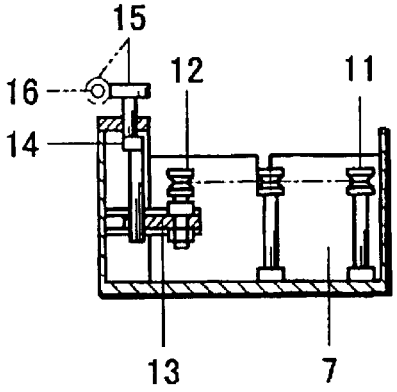
FIG. 4 is a sectional view identical to FIG. 2 when distance between guide rollers at the right side and at the left side is reduced.

A guide roller moving mechanism is provided so as to move the position of the movable guide roller 12 periodically. In the guide roller moving mechanism, as shown in FIG. 1A and FIG. 2, a movable plate 13 is provided at one side in the processing vessel 7 and is movable in lateral direction, and the guide rollers 12 are mounted to the movable plate 13 in equal spacing. The movable plate 13 is connected through a crank mechanism 14 and worm gear mechanism 15 to a drive shaft 16. When the drive shaft 16 is rotated, as shown in FIG. 2 and FIG. 4, the movable plate 13 and the movable guide rollers 12 reciprocate in lateral direction. And the distance between the guide roller 12 at one side and the fixed guide roller 11 at other side is increased or decreased periodically.

The guide rollers 10 at front and rear, and the guide rollers 11,12 at right and left are respectively provided with peripheral grooves where the filament bundle f passes. Each of the peripheral grooves is arranged at such height that sinks into the liquid in the processing vessel 7.

The filament bundle f traveling within the liquid of the processing vessel 7, as shown in FIG. 1A, passes through the guide roller 10 at the inlet side, and then passes through the guide rollers 11, 12 at right and left by turns. And the filament bundle f passes through the guide roller 10 at the outlet side. The filament bundle f is bent in lateral direction at plural times in a zigzag way. When the movable guide rollers 11 reciprocate and the distance between the guide roller 12 and the fixed guide roller 11 is increased or decreased periodically, the filament bundle f becomes stretched and slackened by turns during traveling within the liquid of the processing vessel 7. The traveling speed of the filament bundle f and the reciprocation speed of the movable guide roller 12 are set so that the slack is generated in the filament bundle f during traveling.

In each of the water washing parts 20, an air nozzle and a water nozzle are set along the traveling path of the filament bundle f. The air flow jetting from the air nozzle and the water flow jetting from the water nozzle collide respectively with the filament bundle f during traveling.

The neutralization part 21, as shown in FIG. 1A, is provided with a processing vessel 7 holding a neutralization liquid, collecting vessels 8, passage ports 9, guide rollers 10, 11, 12, and a moving mechanism 13 to 16 for the guide roller 12 in similar manner to the etching part 6. However, the number of the guide rollers 11, 12 is less than that in the etching part 6. This is determined based on the traveling distance of the filament bundle f in the processing liquid, that is, the immersion time or the processing time of the filament bundle f.

The surface adjustment part 22 is provided with a processing vessel 7 holding a surface adjustment liquid, that is, silane coupling agent for adhering a catalyst, collecting vessels 8, passage ports 9, guide rollers 10, 11, 12, and a moving mechanism 13 to 16 for the guide rollers 12 in similar manner to the etching part 6.

The catalyst part 23, as shown in FIG. 1B, is provided with a processing vessel 7 holding a catalyst liquid, collecting vessels 8, passage ports 9, guide rollers 10, 11, 12, and a moving mechanism 13 to 16 for the guide rollers 12 in similar manner to the etching part 6. However, the number of the guide rollers 11, 12 is less than that in the etching part 6.

The accelerator part 24 is provided with a processing vessel 7 holding an accelerator liquid, collecting vessels 8, passage ports 9, guide rollers 10, 11, 12, and a moving mechanism 13 to 16 for the guide roller 12 in similar manner to the etching part 6.

The electroless plating part 25 is provided with a processing vessel 7 holding an electroless plating liquid, collecting vessels 8, passage ports 9, guide rollers 10, 11, 12, and a moving mechanism 13 to 16 for the guide roller 12 in similar manner to the etching part 6. However, the number of the guide rollers 11, 12 is more than that in the etching part 6.

The acid washing part 26, as shown in FIG. 1C, is provided with a processing vessel 7 holding an acid washing liquid, collecting vessels 8, passage ports 9, guide rollers 10, 11, 12, and a moving mechanism 13 to 16 for the guide rollers 12 in similar manner to the etching part 6. However, the number of the guide rollers 11, 12 is less than that in the etching part 6.

The traveling drive part 30 serving as the cathode feeding part is the same as the traveling drive part 4 except that the drive roller serves as a cathode feeding part of an electroplating power source. In the traveling drive part 30, the filament bundle f contacts with the drive roller serving as a cathode feeding part during traveling.

The first electroplating part 31 is provided with a processing vessel 7 holding a first electroplating liquid, collecting vessels 8, passage ports 9, guide rollers 10, 11, 12, and a moving mechanism 13 to 16 for the guide rollers 12 in similar manner to the etching part 6. Further, an anode feeding part 32 corresponding to the cathode feeding part 30 serving as a traveling drive part is provided within the processing vessel 7.

The second electroplating part 33 is provided with a processing vessel 7 holding a second electroplating liquid, collecting vessels 8, passage ports 9, guide rollers 10, 11, 12, a moving mechanism 13 to 16 for the guide roller 12, and an anode feeding part 32 in similar manner to the first electroplating part 31.

The warm water washing part 35, as shown in FIG. 1C, is provided with an air nozzle and a warm water nozzle along a traveling path of the filament bundle f. An air flow jetting from the air nozzle and a warm water flow jetting from the warm water nozzle collide respectively with the filament bundle f during traveling. The warm wind drying part 36, as shown in FIG. 1D, is provided with a warm wind nozzle along the traveling path of the filament bundle f A warm wind jetting from the warm wind nozzle collides with the filament bundle f during traveling.

In the take-up part 41, as shown in FIG. 1D, a mechanism 42 for decreasing the slackness amount of the filament bundle f during loosening of the filament bundle f is provided, and a drive shaft 43 assembling a take-up reel R is provided laterally. An apparatus, which is not shown in the drawings, is provided so as to rotate the drive shaft 43. The filament bundle f with each filament subjected to electroplating passes through the slackness decreasing mechanism 42 and is taken up to the take-up reel R which is assembled to the drive shaft 43.

Figure 5:
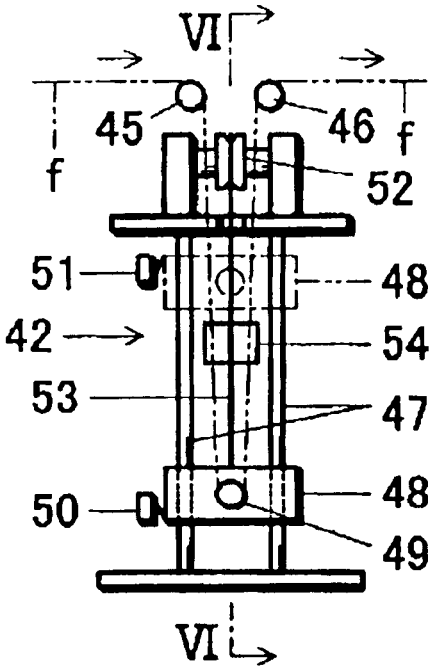
FIG. 5 is an enlarged front view of a slackness decreasing mechanism of the apparatus.

The slackness decreasing mechanism 42, as shown in FIG. 5, is provided with an inlet guide roller 45 and an outlet guide roller 46 at the inlet side and the outlet side. Two guide columns 47 are provided at the inlet side and the outlet side with a movable body 48 being in movable vertically. An adjustment roller 49 is mounted to the movable body 48. The adjustment roller 49 is in movable vertically at lower position between the inlet guide roller 45 and the outlet guide roller 46. The inlet guide roller 45, the outlet guide roller 46 and the adjustment roller 49 are provided with peripheral grooves where the filament bundle f passes.

The filament bundle f passes through upper side of the inlet guide roller 45, lower side of the adjustment roller 49 and upper side of the outlet guide roller 46 in sequence. In the movable body 48 and the adjustment roller 49, the weight of their own, that is, the downward force acts, also the upward force acts from the filament bundle f. When the filament bundle f is loosened, the movable body 48 and the adjustment roller 49 are lowered by the weight of their own, and the adjustment roller 49 gets away from the inlet guide roller 45 and the outlet guide roller 46, and the slackness amount of the filament bundle f is decreased. Tangling of the filament bundle f with each other due to the increase of the slackness amount, the drop of the filament bundle f from the guide rollers 10, 11, 12, contact of the filament bundle f with the processing vessel 7 or the like can be prevented.

When the movable body 48 and adjustment roller 49 reach the lower limit, that is, the far point, as shown in solid line in FIG. 5, the movable body 48 operates a far point detection switch 50. When the switch 50 is operated, the drive shaft 43 is rotated and the take-up reel R assembled to the drive shaft 43 is rotated. Then the filament bundle f is taken up to the take-up reel R, and the movable body 48 and the adjustment roller 49 rise and gets close to the inlet guide roller 45 and the outlet guide roller 46. When the movable body 48 and the adjustment roller 49 reach the upper limit, that is, the near point, as shown in chain line in FIG. 5, the movable body 48 operates a near point detection switch 51. When the switch 51 is operated, the drive shaft 43 is stopped and the take-up reel R is stopped. Then the take-up of the filament bundle f is stopped and the rise of the movable body 48 and the adjustment roller 49 is stopped. Again when the filament bundle f is loosened, the adjustment roller 49 gets away from the inlet guide roller 45 and the outlet guide roller 46, and the slackness amount of the filament bundle f is decreased.

Figure 6:
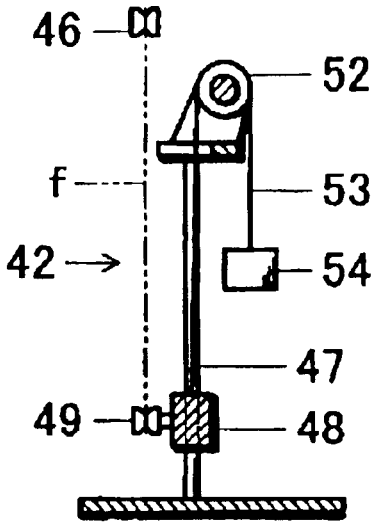
FIG. 6 is a sectional view taken in line VI—VI in FIG. 5.

The slackness decreasing mechanism 42 is provided with an adjustment mechanism for adjusting the slackness decrease amount. In the adjustment mechanism, as shown in FIG. 5 and FIG. 6, a pulley 52 is provided at the upper position of the movable body 48 and a rope 53 is hung to the pulley 52. One end of the rope 53 is connected to the movable body 48, and the other end is connected to a weight 54. The total weight of the movable body 48 and the adjustment roller 49 is heavier than that of the weight 54. The movable body 48 and the adjustment roller 49 are moved downward by the force of the total weight subtracted by the weight 54, and the force pulls the filament bundle f. When the force for the adjustment roller 49 to pull the filament bundle f becomes large, the slackness decrease amount is increased. That is, the increase or decrease of the weight of the weight 54 can adjust the slackness decrease amount.

[Use Method of Plating Apparatus, Plating Method]

In the take-up part 41, an empty take-up reel R is assembled. In the unwinding part 1, a reel r with a filament bundle f wound thereon is assembled. The filament bundle f is unwound from the reel r. The filament bundle f passes through the parts arranged between the unwinding part 1 and the take-up part 41 in sequence, and is connected to the take-up reel R of the take-up part 41. Each processing vessel 7 is supplied with a processing liquid. In the first electroplating part 31 and the second electroplating part 33 respectively, the cathode feeding part 30 and the anode feeding part 32 are energized. In each of the traveling drive parts 4, 30, the drive rollers are rotated.

Also the drive shaft 16, which is common to the etching part 6, the neutralization part 21, the surface adjustment part 22, the catalyst part 23, the accelerator part 24, the electroless plating part 25, the acid washing part 26, the first electroplating part 31 and the second electroplating part 33, is rotated. In these parts, the movable guide rollers 12 reciprocate and move synchronously.

When the plating apparatus operates, the filament bundle f is unwound from the reel r in the unwinding part 1, and passes through the traveling drive part 4 and further passes through the etching part 6.

In the etching part 6, the filament bundle f travels within the etching liquid in the processing vessel 7, and passes through the guide roller 10 at the inlet side, as shown in FIG. 1A, and passes through the guide rollers 11, 12 in the right side and the left side alternately and is bent plural times to the right and to the left, and then passes through the guide roller 10 at the outlet side. The movable guide rollers 12 reciprocate, and the distance between the movable guide roller 12 and the fixed guide roller 11 is increased or decreased periodically. The filament bundle f becomes stretched and slackened by turns while it travels within the etching liquid in the processing vessel 7. Whenever the filament bundle f is slackened or untied, the bundle is loosened and the etching liquid is exchanged between the inside and the outside of the bundle. Each filament of the filament bundle f is subjected to the etching processing uniformly. After the etching processing, the filament bundle f passes through the traveling drive part 4 and then passes through the water washing part 20, and is washed by the air and the water in the water washing part 20. The filament bundle f passes through the traveling drive part 4 and then passes through the neutralization part 21.

In the neutralization part 21, the filament bundle f travels within the neutralization liquid in the processing vessel 7, and passes through the guide roller 10 at the inlet side, and passes through the guide rollers 11, 12 at the right side and the left side alternately and is bent to the right and to the left, and passes through guide roller 10 at the outlet side. The movable guide rollers 12 move in reciprocation, and distance between the guide rollers 11, 12 on both sides is increased or decreased periodically. The filament bundle f becomes stretched and slackened by turns, and every time the bundle is slackened or untied, the bundle is loosened and the neutralization liquid is exchanged between the inside and the outside of the bundle. Each filament is subjected to the neutralization processing uniformly. After the neutralization processing, the filament bundle f passes through the traveling drive part 4 and then passes through the water washing part 20, and is washed in the water washing part 20. The filament bundle f passes through the traveling drive part 4 and passes through the surface adjustment part 22.

In the surface adjustment part 22, the filament bundle f travels within the silane coupling agent for adhering the catalyst, that is, the surface adjustment liquid in the processing vessel 7, and passes through the guide roller 10 at the inlet side, and through the guide rollers 11, 12 at the right side and the left side and the guide roller 10 at the outlet side in sequence. The movable guide rollers 12 move in reciprocation periodically. The filament bundle f becomes stretched and slackened by turns, and every time the bundle is untied, the bundle is loosened and the surface adjustment liquid is exchanged between the inside and the outside of the bundle. Each filament is subjected to the surface adjustment processing uniformly. After the surface adjustment, the filament bundle f passes thought the traveling drive part 4 and then passes through the water washing part 20, and passes thought the traveling drive part 4 and then passes through the catalyst part 23.

In the catalyst part 23, the filament bundle f travels within the catalyst liquid in the processing vessel 7, and as shown in FIG. 1B, it passes through the guide rollers 10, 12, 11, 10 in sequence. The movable guide rollers 12 move in reciprocation periodically. The filament bundle f is stretched and slackened by turns, and every time the bundle is untied, the bundle is loosened and the catalyst liquid is exchanged between the inside and the outside of the bundle. Each filament is subjected to the catalyst processing uniformly. After the catalyst processing, the filament bundle f passes through the traveling drive part 4 and the water washing part 20, and passes through the traveling drive part 4 and then passes through the accelerator part 24.

In the accelerator part 24, the filament bundle f travels within the accelerator liquid in the processing vessel 7 and passes through the guide rollers 10, 12, 11, 10. The movable guide rollers 12 move in reciprocation periodically. The filament bundle f is stretched and slackened by turns, and every time the bundle is untied, the bundle is loosened and the accelerator liquid is exchanged between the inside and the outside of the bundle. Each filament is subjected to the accelerator processing uniformly. After the accelerator processing, the filament bundle f passes through the traveling drive part 4, the water washing part 20 and the traveling drive part 4, and passes through the electroless plating part 25.

In the electroless plating part 25, the filament bundle f travels within the electroless plating liquid in the processing vessel 7, and passes through the guide rollers 10, 12, 11, 10. The filament bundle f is stretched and slackened by turns, and every time the bundle is untied, the bundle is loosened and the electroless plating liquid is exchanged between the inside and the outside of the bundle. Each filament is subjected to the electroless plating processing uniformly. After the electroless plating is applied, the filament bundle f passes through the traveling drive part 4, the water washing part 20 and the traveling drive part 4, and then passes through the acid washing part 26.

In the acid washing part 26, the filament bundle f travels within the acid washing liquid in the processing vessel 7, and passes through the guide rollers 10, 12, 11, 10. The filament bundle f is stretched and slackened by turns, and every time the bundle is untied, the bundle is loosened and the acid washing liquid is exchanged between the inside and the outside of the bundle. Each filament is subjected to the acid washing processing uniformly. After the acid washing processing, the filament bundle f passes through the traveling drive part 4 and the water washing part 20. And it passes through the traveling drive part 30 at the inlet side serving as the cathode feeding part of the first electroplating part 31, and then passes through the first electroplating part 31 and the traveling drive part 30 at the outlet side serving as the cathode feeding part of the first electroplating part 31.

In the first electroplating part 31, the filament bundle f travels within the first electroplating liquid above the anode feeding part 32 in the processing vessel 7, and passes through the guide rollers 10, 12, 11, 10. The filament bundle f is stretched and slackened by turns, and every time the bundle is untied, the bundle is loosened and the first electroplating liquid is exchanged between the inside and the outside of the bundle. Each filament is subjected to the electroplating processing uniformly. After the first electroplating is applied, the filament bundle f passes through the traveling drive part 30 at the inlet side serving as the cathode feeding part of the second electroplating part 33, and then passes through the second electroplating part 33 and the traveling drive part 30 at the outlet side serving as the cathode feeding part of the second electroplating part 33.

In the second electroplating part 33, the filament bundle f travels within the second electroplating liquid above the anode feeding part 32 in the processing vessel 7, and passes through the guide rollers 10, 12, 11, 10. The filament bundle f is stretched and slackened by turns, and every time the bundle is untied, the bundle is loosened and the second electroplating liquid is exchanged between the inside and the outside of the bundle. Each filament is subjected to the electroplating processing uniformly.

After the second electroplating is applied, the filament bundle f passes through the water washing part 20, and then passes through the warm water washing part 35 and is washed by the air and the warm water. Subsequently it passes through the warm wind drying part 36 and is dried by the warm wind. The filament bundle f passes through the traveling drive part 4 and reaches the take-up part 41.

In the take-up part 41, the filament bundle f passes through the slackness decreasing mechanism 42 and is taken up to the take-up reel R. The filament bundle with each filament subjected to electroplating uniformly can be manufactured continuously and efficiently.

EXAMPLES OF THE PLATING

Example 1, Where Electroplating of Copper is Applied to Filaments of Polyester The filament bundle f is a bundle of polyester filaments of one hundred to several hundreds in number. The traveling speed of the filament bundle f is 50 cm per minute. In the movable guide rollers 12, the reciprocating stroke is 10 cm and the reciprocating frequency is 3 to 4 times per minute. The distance between the movable guide roller 12 and the fixed guide roller 11 is about 50 cm.

The etching liquid is an aqueous solution in 5% of sodium hydroxide (NaOH), in which the temperature is 45 degrees C. and the immersion time is 5 minutes. The neutralization liquid is an aqueous solution in 5% of hydrochloric acid (HCl), in which the temperature is room temperature and the immersion time is 2 minutes.

The silane coupling agent for adhering the catalyst, the surface adjustment liquid is an aqueous solution in 0.1% of alfa-aminoethyltriethoxy silane, in which the temperature is 50 degrees C. and the immersion time is 5 minutes. The catalyst liquid includes palladium chloride ($PdCl_2$) 0.1 g, tin dichloride ($SnCl_2$) 15 g and hydrochloric acid (HCl) 200 ml per 1 liter of the aqueous solution, in which the temperature is 40 degrees C. and the immersion time is 3 minutes. The accelerator liquid is an aqueous solution in 10% of sulfuric acid ($H_2SO_4$), in which the temperature is 40 degrees C. and the immersion time is 3 minute.

The electroless plating liquid is for copper (Cu) plating, and includes copper sulfate ($CuSO_4.5H_2O$) 10 g, potassium sodium tartrate ($C_4H_4O_6KNa.4H_2O$, Rochelle Salt) 100 g, sodium hydroxide (NaOH) 12 g, formalin (HCHO) 20 ml and stabilizer of little amount per 1 liter of the aqueous solution, in which the temperature is 35 degrees C. and the immersion time is 15 minutes. The acid washing liquid is an aqueous solution in 10% of sulfuric acid ($H_2SO_4$), in which the temperature is room temperature and the immersion time is 1 minute.

The first electroplating liquid and the second electroplating liquid are for copper (Cu) plating, and each includes copper sulfate ($CuSO_4.5H_2O$) 200 g and sulfuric acid ($H_2SO_4$) 50 g per 1 liter of the aqueous solution, in which the temperature is room temperature and the immersion time is 10 minutes. The current density is 0.5 $A/dm^2$ in the first electroplating liquid and 2 $A/dm^2$ in the second electroplating liquid.

In the polyester filament bundle, each filament is subjected to electroplating of copper of 4 micro m thickness. The electroplating of copper was not peeled off in the tape test.

Example 2, Where Electroplating of Nickel is Applied to Filaments of Aramid

The filament bundle f is a bundle of aramid filaments of one hundred to several hundreds in number. The traveling speed is 60 cm per minute. In the movable guide rollers 12, the reciprocating stroke is 5 cm and the reciprocating frequency is 6 to 8 times per minute. The distance between the movable guide roller 12 and the fixed guide roller 11 is about 50 cm.

The etching liquid is an aqueous solution of chromic acid anhydride ($CrO_3$) 30% and sulfuric acid ($H_2SO_4$) 15%, in which the temperature is 50 degrees C. and the immersion time is 5 minutes. The neutralization liquid is an aqueous solution in 10% of sodium bisulfate or sodium acid bisulfate ($NaHSO_3$), in which the temperature is room temperature and the immersion time is 2 minutes.

The silane coupling agent for adhering the catalyst, the surface adjustment liquid, the catalyst liquid and the accelerator liquid are the same as that in the Example 1 respectively.

The electroless plating liquid is for nickel (Ni) plating, and includes nickel sulfate ($NiSO_4.7H_2O$) 20 g, sodium hypophosphate ($NaPH_2O_2.H_2O$) 20 g, sodium citrate ($Na_3C_6H_5O_7.2H_2O$) 40 g, aqua ammonia (NH) 10 ml and stabilizer of little amount per 1 liter of the aqueous solution, in which the temperature is 30 degrees C. and the immersion time is 10 minutes. The acid washing liquid is the same as that in the Example 1.

The first electroplating liquid and the second electroplating liquid are for nickel (Ni) plating, and each includes nickel sulfate ($NiSO_4.7H_2O$) 280 g, nickel chloride ($NiCl_2.6H_2O$) 50 g and boracic acid ($H_3BO_3$) 40 g per 1 liter of the aqueous solution, in which the temperature is 50 degrees C. and the immersion time is 10 minutes. The current density is 0.5 $A/dm^2$ in the first electroplating liquid and 2 $A/dm^2$ in the second electroplating liquid.

In the aramid filament bundle, each filament is subjected to electroplating of nickel of 6 micro m thickness. The electroplating of nickel was not peeled off in the tape test.

Example 3, Where Electroplating of Silver is Applied to Filaments of Rayon

The filament bundle f is a bundle of rayon filaments of one hundred to several hundreds in number. The traveling speed is 70 cm per minute. In the movable guide rollers 12, the reciprocating stroke is 10 cm and the reciprocating frequency is 4 to 5 times per minute. The distance between the movable guide roller 12 and the fixed guide roller 11 is about 50 cm.

The etching liquid is an aqueous solution in 3% of sodium hydroxide (NaOH), in which the temperature is 45 degrees C. and the immersion time is 5 minutes. The neutralization liquid is an aqueous solution in 3% of hydrochloric acid (HCl), in which the temperature is room temperature and the immersion time is 2 minutes.

The silane coupling agent for adhering the catalyst, the surface adjustment liquid, the catalyst liquid and the accelerator liquid are the same as that in the Example 1 respectively. The electroless plating liquid is for copper (Cu) plating, and is the same as that in the Example 1. The acid washing liquid is the same as that in the Example 1.

The first electroplating liquid and the second electroplating liquid are for silver (Ag) plating, and each includes silver cyanide (AgCN) 60 g and potassium cyanide (KCN) 160 g per 1 liter of the aqueous solution, in which the temperature is room temperature and the immersion time is 7 minutes. The current density is 0.5 $A/dm^2$ in the first electroplating liquid and 1 $A/dm^2$ in the second electroplating liquid.

In the rayon filament bundle, each filament is subjected to electroplating of silver of 5 micro m thickness. The electroplating of silver was not peeled off in the tape test.

Example 4, Where Electroplating of Silver is Applied to Filaments of Polyphenylene Sulfide The filament bundle f is a bundle of polyphenylene sulfide filaments of one hundred to several hundreds in number. The traveling speed is the same as that in the Example 3. In the movable guide rollers 12, the reciprocating stroke and the reciprocating frequency are the same as those in the Example 3.

The etching liquid is a solution of nitric acid ($HNO_3$) that ammonium acid fluoride ($NH_4HF_2$) 130 g is added per 1 liter of the nitric acid, in which the temperature is 40 degrees C. and the immersion time is 5 minutes. The neutralization liquid is an aqueous solution in 1% of sodium hydroxide (NaOH), in which the temperature is room temperature and the immersion time is 2 minutes.

The silane coupling agent for adhering the catalyst, the surface adjustment liquid, the catalyst liquid and the accelerator liquid are the same as those in the Example 1 respectively.

The electroless plating liquid is for silver (Ag) plating, and comprises a first electroless plating liquid and a second electroless plating liquid. In the plating apparatus, the electroless plating part 25 comprises a first electroless plating part of which processing liquid is the first electroless plating liquid, and a second electroless plating part of which processing liquid is the second electroless plating liquid. The filament bundle f passes through the first electroless plating part and the second electroless plating part in sequence. The first electroless plating liquid includes silver nitrate ($AgNO_3$) 9 g and ammonium sulfate ($(NH_4)_2SO_4$) 50 g per 1 liter of the aqueous solution, in which the temperature is room temperature and the immersion time is 10 minutes. The second electroless plating liquid includes formalin (HCHO) 50 ml, in which the temperature is room temperature and the immersion time is 10 minutes.

The acid washing liquid is the same as that in the Example 1. The first electroplating liquid and the second electroplating liquid are the same as those in the Example 3 respectively.

In the polyphenylene sulfide filament bundle, each filament is subjected to electroplating of silver of 5 micro m thickness. The electroplating of silver was not peeled off in the tape test.

Example 5, Where Electroplating of Copper is Applied to Filaments of Carbon

The filament bundle f is a bundle of carbon filaments of one hundred to several hundreds in number. The traveling speed is the same as that in the Example 1. In the movable guide rollers 12, the reciprocating stroke and the reciprocating frequency are the same as those in the Example 1.

The etching liquid and the neutralization liquid are not used. In the plating apparatus, the etching liquid is not supplied to the etching part 6, and the neutralization liquid is not supplied to the neutralization part 21. The filament bundle f passes through the etching part 6 of which the processing vessel 7 is empty, and the neutralization part 21 of which the processing vessel 7 is empty. Or the plating apparatus is not provided with the etching part 6 and the neutralization part 21. The filament bundle f passes through the surface adjustment part 22 without passing the etching part 6 and the neutralization part 21.

The surface adjustment liquid, the catalyst liquid and the accelerator liquid are the same as those in the Example 1 respectively. The electroless plating liquid, the acid washing liquid, the first electroplating liquid and the second electroplating liquid are the same as those in the Example 1 respectively.

In the carbon filament bundle, each filament is subjected to electroplating of copper of 4 micro m thickness. The electroplating of copper was not peeled off in the tape test.

What is claimed is:

1. An apparatus of continuous plating of filament bundle comprising:

an unwinding part in which a reel with filament bundle wound thereon is set and the filament bundle is unwound from the reel, various sorts of liquid processing vessels to be used for the plating, which the filament bundle passes through and is subjected to plating, a take-un part in which a take-up reel is set and the filament bundle with each filament subjected to plating is wound on the take up reel, a fixed guide roller and a movable guide roller, which the filament bundle passes through, provided in the processing vessel, and a mechanism for moving the position of the movable guide roller periodically, whereby the filament bundle is stretched and slackened by turns while the filament bundle travels within the liquid in the processing vessel.

2. An apparatus according to claim 1, wherein said fixed guide roller is arranged at one side, and said movable guide roller is arranged at another side within the processing vessel, said filament bundle passes through the fixed guide roller and the movable guide roller by turns and is bent.

3. An apparatus according to claim 2, wherein the apparatus further includes an inlet guide roller, an adjustment roller being movable, and an outlet guide roller where the filament bundle passes through, and the adjustment roller is subjected to force in reverse direction to the force to be received from the filament bundle, and when the filament bundle is loosened, the adjustment roller moves away from the inlet guide roller and the outlet guide roller, whereby decreasing the slackness amount of the filament bundle.

4. An apparatus according to claim 1, wherein the apparatus further includes an inlet guide roller, an adjustment roller being movable, and an outlet guide roller where the filament bundle passes through, and the adjustment roller is subjected to force in reverse direction to the force to be received from the filament bundle, and when the filament bundle is loosened, the adjustment roller moves away from the inlet guide roller and the outlet guide roller, whereby decreasing the slackness amount of the filament bundle.

* * * * *